United States Patent [19]

Hughes et al.

[11] 4,367,057

[45] Jan. 4, 1983

[54] METHOD OF FORMING A FOUNDATION WITH LIQUID TIGHT JOINTS

[75] Inventors: John Hughes, Arlington Heights, Ill.; Heinz Rasbach, Zellhausen, Fed. Rep. of Germany

[73] Assignee: American Colloid Company, Skoki, Ill.

[21] Appl. No.: 77,650

[22] Filed: Sep. 21, 1979

Related U.S. Application Data

[63] Continuation-in-part of Ser. No. 964,000, Nov. 27, 1978, abandoned, which is a continuation of Ser. No. 831,358, Sep. 8, 1977, abandoned.

[51] Int. Cl.[3] ..... E02D 5/10; E02D 27/00

[52] U.S. Cl. ..... 405/267

[58] Field of Search ..... 405/267, 107, 258, 263, 405/264, 265, 266, 268; 52/169.14, 396, 742, 743, 744; 404/74

[56] References Cited

U.S. PATENT DOCUMENTS

| | | | |
|---|---|---|---|
| 2,277,286 | 3/1942 | Bechtner | 405/107 |
| 3,422,627 | 1/1969 | Courte | 405/267 |
| 3,949,560 | 4/1976 | Clem | 405/264 |
| 3,986,365 | 10/1976 | Hughes | 405/264 |

OTHER PUBLICATIONS

Volclay—Its use in Slurry Trenching and Diaphragm Wall Consruction Projects, American Colloid Co., 1971.

*Primary Examiner*—David H. Corbin

*Attorney, Agent, or Firm*—Poms, Smith, Lande & Rose

[57] ABSTRACT

A method of constructing an in-ground liquid barrier in separate sections with liquid tight joints between the sections. A barrier area is excavated and the sections formed therein, preferrably by initially filling the excavation with a liquid sealing slurry and sequentially displacing portions of the slurry with a liquid impermeable barrier material to form barrier sections which are mutually abutting along leaky interfaces. A bore is drilled between adjacent sections in a direction generally transverse to the direction of leakage, and filled with a liquid sealing material to seal the joint. The sealing material preferrably comprises a dry, hydro-expandable bentonite composition which expands to form a slurry sealant by permitting liquid to seep between the barrier sections into the bore and contact the bentonite therein.

4 Claims, 14 Drawing Figures

5
5
6
6
7
7

METHOD OF FORMING A FOUNDATION WITH LIQUID TIGHT JOINTS

This application is a continuation in-part of application Ser. No. 964,000, filed Nov. 27, 1978 (now abandoned), which, in turn, was a continuation of Ser. No. 831,358, filed Sept. 8, 1977 (now abandoned).

BACKGROUND OF THE INVENTION

A. Field of the Invention

This invention relates to the construction art, and more particularly to a method of forming underground foundations with liquid tight joints.

B. Description of the Prior Art

There are numerous requirements for in-ground, water impermeable foundations in the construction trade. For example, trenches can be dug in the ground and filled with concrete to halt water seepage, or to allow an excavation to proceed without seriously upsetting the geology of the surrounding land. Water tight construction is also highly desirable for building foundations. When the trenches or foundation sites are dug through solid clay or rock, the sides of the excavation are usually solid enough to enable the achievement of a considerable depth with either a back hoe or a drag-line digging machine. However, such conditions do not ordinarily exist where the ground is saturated with water and is composed of silt, sand and/or gravel.

If the water table is reached while attempting to dig a deep, narrow trench in a saturated sandy soil, the movement of water into the trench loosens the sand and collapses the structure, causing the entire formation to fall. In order to reach the desired depth, the trench may ultimately have to be made so wide on the surface as to render the cost of filling prohibitive.

This problem has been substantially overcome in the past by a technique commonly known as slurry trenching or diaphragm wall construction. This construction technique involves keeping the trench filled during digging with a slurry formed from a mixture of bentonite and water. As digging proceeds and more slurry is added, a tough, flexible seal forms on the inside of the trench and stops the flow of water through the trench walls. This film, together with the pressure of the slurry behind it, holds the walls upright and water tight. During continued digging, the slurry moves into the freshly exposed dirt and commences its sealing action.

When the trench has been dug to the desired depth and filled with slurry, metal pipes spanning the width of the trench are lowered into one section and act as lateral stops to isolate the section during its subsequent formation. The section is then filled with a water impermeable material such as concrete, clay, or a mixture of clay, sand and gravel while slurry is simultaneously displaced from the trench section, preferably for recovery and reuse. The foundation material is then allowed to harden until the pipes at either end can be removed without the newly formed wall collapsing into the remainder of the trench. After removal of the pipes, another section adjacent to the first section is formed by placing a pipe at the far end of the new section, and filling the new section with foundation material while simultaneously displacing the slurry therein. After the new section has hardened sufficiently, additional sections can be formed in the same manner until the desired wall length is attained. With the use of this method and sophisticated digging equipment, depths of several hundred feet have been achieved.

Bentonite, and specifically sodium bentonite, has a property which makes it particularly useful as the agent for forming the slurry. When dispersed in water, sodium bentonite adsorbs water onto the surface of its platelets, giving rise to a multitude of individual platelets of clay, each surrounded by a water jacket. This water jacket gives bentonite the ability to develop viscosity in water, and also to line the trench walls with a tough, thin film which reduces water permeability.

While the above technique represents a marked advance over previous methods, there is still room for further improvement. Specifically, when a new section of concrete is poured it does not form a perfect bond with the previously poured section, at least partly because the previous section retains a slurry coating. This creates an area of potential leakage for water to seep through the wall along the joint between adjacent sections. In some cases the seepage problem has been severe enough to require the construction of additional wall sections parallel to the primary foundation and adjacent each joint to stop leakage through the joints.

Another method for inhibiting leakage is disclosed in U.S. Pat. No. 3,422,627 to Courte. In one embodiment, described in connection with FIGS. 4 and 5 of the Courte patent, a new foundation section or panel is initially filled with mud and a "key tube" inserted in the mud against an adjacent concrete section. When the new section has been cast with concrete and set, the key tube is removed, leaving behind a recess full of mud. It is next necessary to empty the recess of mud and wash its walls, following an optional step of boring to enlarge the recess and cut through the surface joining the two foundation sections. The recess may then be injected under pressure with a suspension of cement to make it water tight.

An alternate embodiment is described in connection with FIGS. 6–9 of the Courte patent. In this embodiment, a first key tube is held upright in the first foundation section to be cast by attachment to a stop end tube positioned at the far end of the section. After the section has been filled with concrete, the first key tube is disconnected from the stop end tube and both tubes are removed independently from the trench. A guiding tube is then inserted into the recess left by removal of the first key tube. Attached to and guided by the guiding tube is a second key tube which is held in the next foundation section tangentially to the first key tube recess. The second foundation section is then cast with concrete, after which the guiding tube and second key tube are removed to leave adjacent recesses in the first and second foundation sections which open into each other through a restricted opening defined by concrete projections or tongues.

In the next step of this embodiment of Courte, cake is required to be removed by an emulsifier and, if necessary, by sweeping each of the recesses in its turn by flue brushes operating in the recesses in alternation with the emulsifier. The projections or tongues restricting the opening between the two recesses may then be cut off by a boring bit, resulting in an oval cross-section for the recesses. The dual recess is then checked for fluid tightness and cleaned, and a suitable reinforcement layed if required. Finally, the recess is cast with concrete.

While the approach of the Courte patent is theoretically sound, there are practical limitations to its application, and it has been found to be unnecessarily complicated. For example, in each embodiment special attention must be paid to proper positioning of the key tubes. Thus, for the first embodiment the technique of casting sand into the key tube to prevent it from shifting and prevent interior concrete from rising is described, while for the second embodiment various methods of securing the second key tube to the guiding tube are described.

Since each of the key tubes of Courte is set in concrete and must be withdrawn to create a recess, it is important that they be positioned vertically. In certain situations the concrete may freeze around the key tube and make it virtually impossible to withdraw. In other cases, the contractor may choose to "break" the key tube away after the concrete has set in order to withdraw it. In this action, the tearing of the tube out of the concrete could destroy the edge of the concrete section. Furthermore, in both Courte embodiments a mud residue is left in the recess and must be removed to make the joint between sections reliably fluid tight.

The Courte approach is further limited because of the shrinkage characteristics exhibited by the preferred sealing material for foundation walls, which is a grout consisting essentially of water and Portland cement. When this grout is fluid enough to pump readily, it has high shrinkage characteristics. Shrinkage of the grout after the foundation has been completed may open a space between the grout and the recess it has filled, resulting in additional leakage between foundation sections. Accordingly, there is still a need for an improved method of forming an in-ground foundation that is internally waterproof.

SUMMARY OF THE INVENTION

In view of the above problems associated with the prior art, the primary object of the present invention is the provision of a novel and improved method for constructing a liquid impermeable barrier within a liquid permeable base.

Another object is the provision of a method for constructing a liquid impermeable barrier in separate sections, with liquid tight joints between the sections.

Another object is the provision of a method for utilizing the slurry trenching technique to construct a liquid impermeable barrier which prevents leakage at the interface between sections without the need for auxiliary walls.

Still another object is the provision of a relatively simple and inexpensive method for constructing a barrier which is liquid impermeable along its entire length.

Briefly stated, the method contemplated by the present invention involves sequentially forming a plurality of laterally extending, liquid impermeable barrier sections which mutually abut at their lateral boundaries, removing barrier material simultaneously from adjacent sides of the boundaries to form voids common to adjacent sections, and substantially filling the voids with a liquid sealing material. The interfaces formed between adjacent sections are thereby characterized in a direction transverse to the barrier by leaky end portions at which the sections are substantially mutually abutting, and by an intermediate void portion which is flooded with the liquid sealant to inhibit leakage between the end portions.

The invention is particularly suited to the slurry trenching technique. In this application a generally vertical trench is excavated and substantially filled with a water sealing slurry, preferably comprising an admixture of hydro-expandable bentonite and water. A pair of isolating members are placed in the trench to isolate a first section thereof. One of the members supports a detachable guide member on its side facing the isolated section. A settable, water impermeable wall material is then introduced into the trench section and the slurry simultaneously displaced. After permitting the wall material to harden sufficiently to assume the lateral contours of the isolating members, the guide member is detached and left in the trench as the isolating members are removed. Following formation of the first wall section, another isolating member is placed in the trench, on the guide member aside of the first section and laterally spaced therefrom, to isolate a second trench section. A second wall section having a common lateral boundary with the first wall section is formed in a similar manner by introducing wall material into the trench while simultaneously displacing the slurry from the trench, and permitting the wall material to harden. Additional sections are added as required until the wall reaches the desired length, each isolating member except the last one supporting a detachable guide member.

The resulting multisectional wall will generally suffer water leakage along the interfaces between its sections. In order to make the joints between sections water tight, a bore of sufficient diameter to extend into the barrier material on both sides of the interface is drilled at each interface, using the guide member left in the wall. Bentonite, preferably in pellet form, is then placed in the bore in sufficient quantity to form a water sealing slurry with water which leaks into the bore along the interface. The preferred bentonite pellets are approximately one centimeter in diameter, and are provided as a specified contaminant resistant bentonite composition. An initial leakage partially through the wall is thus actually used as an integral part of the preferred method of forming water tight joints.

DESCRIPTION OF THE DRAWINGS

Further advantages and features of the invention will be apparent to those skilled in the art from the following detailed description thereof, taken together with the accompanying drawings, in which.

DETAILED DESCRIPTION OF A PREFERRED EMBODIMENT

Figures 1, 2, 3, 4:
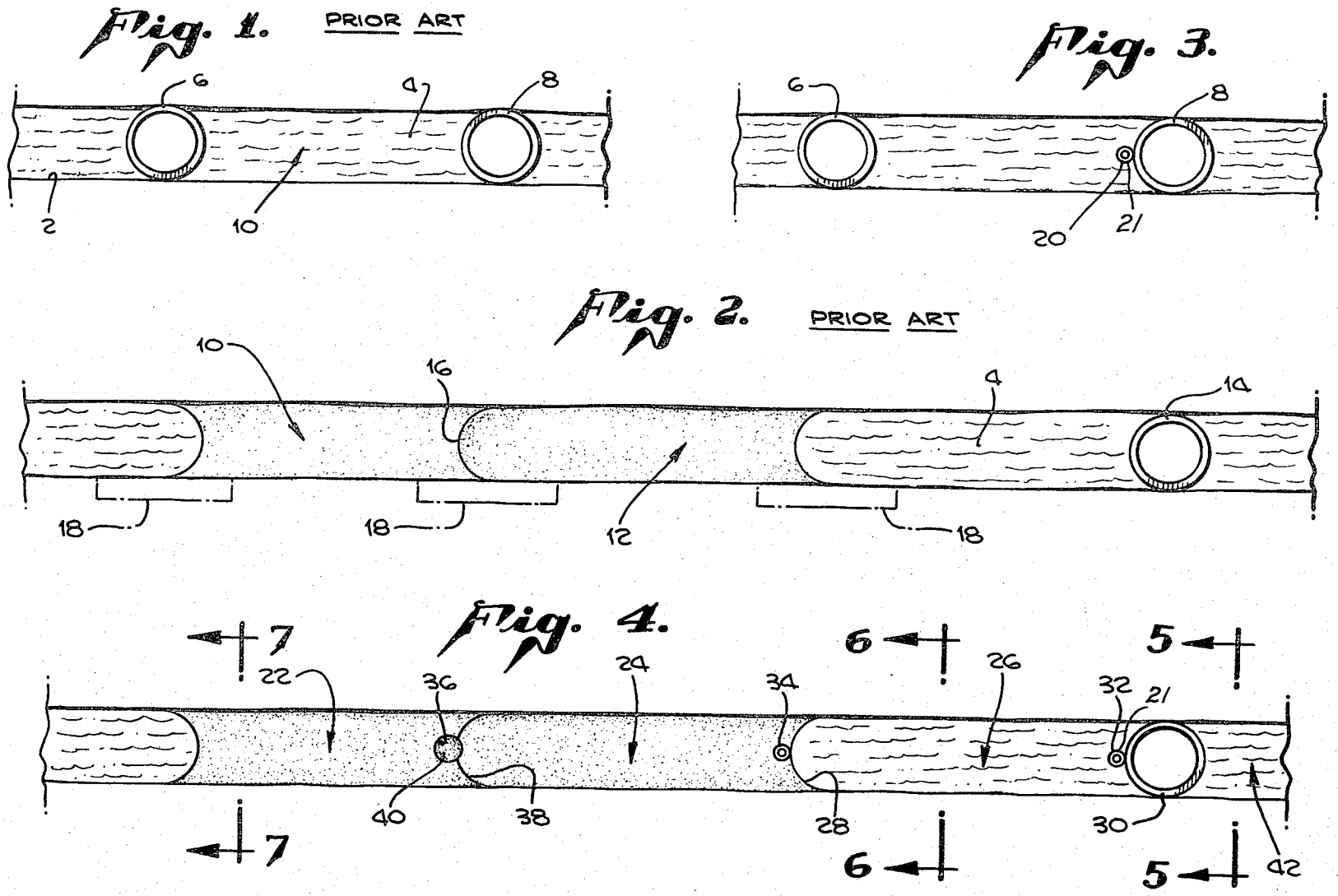
Fig. 1. PRIOR ART
Fig. 2. PRIOR ART
FIGS. 1 and 2 are plan views showing two stages in the construction of an inground foundation wall in accordance with the prior art.
FIGS. 3 and 4 are plan views showing two stages in the construction of an inground foundation wall in accordance with the present invention.

Referring first to FIG. 1, an initial stage in the construction of an inground foundation wall or liquid barrier in accordance with the slurry trenching technique described above is shown. A trench 2 has been dug to a desired depth and simultaneously filled with a slurry 4 comprising a mixture of bentonite and water. The proportionate quantities of the two ingredients for the particular application is generally recommended by the bentonite supplier. The factors to be considered in selecting a proper mixing ratio include the purity of the water, in particular the calcium, magnesium or salt content; the temperature of the water; and the chemical composition of the soil. In general, the slurry should be of a sufficient viscosity to maintain the suspension of fine solids as excavation of the trench progresses, to minimize loss of water from the trench to the surrounding stratas, and to be easily displaced by the concrete fill.

Isolating members such as metal pipes 6 and 8, having diameters sufficient to completely span the width of the trench and act as stops in isolating an intermediate trench section 10, are lowered into the trench after it is flooded with slurry. Once the stage shown in FIG. 1 has been reached, concrete is poured into trench section 10, displacing the slurry therein which is preferably pumped away and reused. When the concrete has hardened enough for the wall section to retain its shape without collapsing into the trench, pipes 6 and 8 are removed and another pipe inserted into the trench, spaced another section distance to the right of section 10. Concrete is then poured into the space between section 10 and the new pipe, displacing the slurry therein and forming a second section. Additional sections are constructed by the same process of successively moving the pipe laterally and pouring concrete into the section between the new pipe location and the existing wall.

FIG. 2 shows the condition of the wall with two sections 10 and 12 completed, and a pipe 14 placed in the trench laterally spaced to the right of section 12 to form the right hand boundary of a third section. Laterally adjacent wall sections 10 and 12 abut each other and are commonly bounded along a curved joint or interface 16, the exact shape of which is determined by the cross-section of the metal pipes. This interface is generally not water tight, the seepage can occur between the sections from one side of the wall to the other. Should the leakage problem be serious supplementary walls 18, constructed alongside the primary wall adjacent the intersectional joints and indicated by dashed lines, were resorted to in the prior art to stem leakage flow.

The leakage problem is solved in a simpler and less expensive manner by the construction technique provided by the present invention. Referring to FIG. 3, the same isolation pipes 6 and 8 are used to form section boundaries as in the prior art. However, in the preferred embodiment a drill guide member 20 is detachably secured to the side of pipe 8 which faces the section to be poured. Guide member 20 preferrably comprises a plastic pipe secured to pipe 8 by means of detachable or breakable clips or a relatively weak adhesive, generally indicated at 21. Member 20 is carried either in contact with the outer surface of pipe 8 or closely adjacent thereto so as to be generally vertically oriented in the trench, as are pipes 6 and 8.

Construction of the wall proceeds generally as in the prior art. However, before removing an isolating pipe from the trench, its attached guide member is first detached and left embedded in the concrete adjacent or slightly spaced from the lateral boundary of the section. A hole or bore of sufficient diameter to extend across the boundary between sections and into the concrete of each section is then drilled, using member 20 as a guide. Following this step the bore is at least partically filled with dry, hydro-expandable bentonite. The bentonite can be provided in numerous forms. For example, pellets can be formed under high pressure and dropped into the bore, or lumps of an appropriate size may simply be taken from a dryer normally used for drying bentonite. Also, the bentonite can be placed in the bore either loose or in packaged form, such as inside a cardboard tube of the mailing tube variety which would deteriorate over a period of time once inside the box. Whatever form the bentonite takes, the formation of an effective liquid seal proceeds along similar lines. Assuming pellets are used, water which subsequently leaks between adjacent sections into the bore is absorbed by the pellets therein, causing them to expand and form a slurry within the bore which seals off the intersectional joint from any leakage. The invention thus actually employs an intital leakage partially through the wall to form a water tight joint.

FIG. 4 shows a wall at an intermediate stage of construction. Two sections 22 and 24 have already been filled with concrete, while a third section 26 is still filled with slurry and bounded laterally on the left by section 24 along interface 28, and on the right by metal isolating pipe 30 and attached plastic guide member 32. Section 24 is shown after the metal pipe forming its right-hand boundary has been detached from its associated guide member 34 and removed, leaving member 34 secured in the concrete adjacent interface 28. Construction of an intersectional joint is shown advanced to completion between sections 22 and 24. A bore 36 has been drilled across the interface 38 between the two sections, using a guide member embedded in concrete on the right hand side of section 22 as a drilling guide. A sufficient quantity of bentonite pellets is then introduced into bore 36 to form a water sealing slug 40 as water gradually seeps through interface 38 into bore 36.

Figure 5:
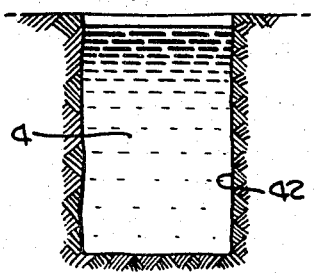
FIGS. 5, 6 and 7 are cross-sectional elevation views taken respectively along the lines 5—5, 6—6, and 7—7 of FIG. 4.
Figure 6:
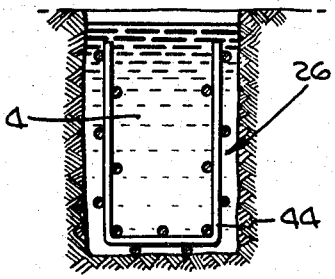
Figure 7:
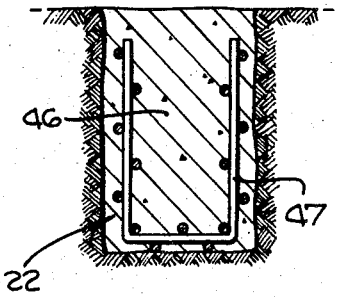

FIGS. 5–7 illustrate the trench at various stages of construction. In FIG. 5 the trench section 42 to the right of isolating pipe 30 has been dug to a substantial depth relative to its width, and is flooded with slurry 4 to prevent the side walls from collapsing. FIG. 6 shows section 26 at a later stage of construction, after it has been isolated and a cage 44 of reinforcing steel lowered through the slurry to rest on the bottom of the trench. FIG. 7 shows completed section 22 filled with concrete 46 which has hardened and set to form a water impermeable barrier. Steel reinforcement 47 is cemented in place within the wall and adds to its structural strength. By comparing FIGS. 5, 6 and 7, it can be seen that the cross-sectional dimensions of the trench are substantially unchanged during the various stages of construction.

Figure 8:
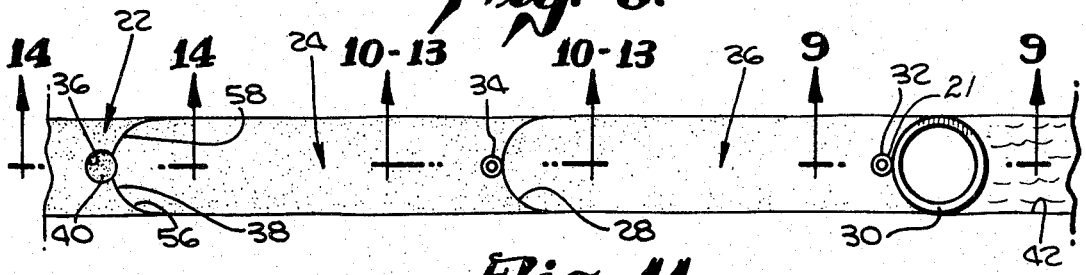
FIG. 8 is a plan view of an inground foundation wall at a construction stage following the stage shown in FIG. 4.
Figure 9:
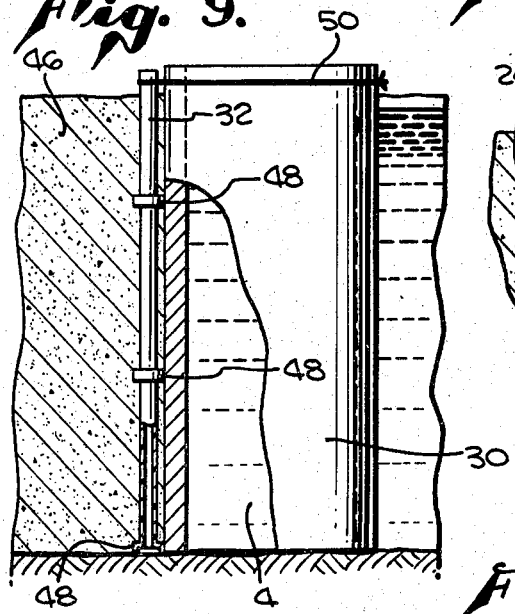
FIG. 9 is a cross-sectional view taken along the lines 9—9 of FIG. 8.

Referring now to FIG. 8, the wall of FIG. 4 is depicted at a somewhat more advanced stage, with section 26 filled with concrete. FIG. 9 shows the metal pipe 30 and drill guide member 32 which form the right hand lateral boundary of section 26. Guide member 32 comprises a plastic pipe having a plurality of annular rings or flares 48 spaced along its length to assist in holding it in the concrete when pipe 30 is removed. Member 32 is shown secured to pipe 30 at the top by a band 50, which is removed prior to lifting pipe 30 out of the trench. Other means of attachment such as a weak adhesive bond or breakable coupling, generally indicated as 21 in FIG. 3, could also be used to hold the pipe and guide member together, the important factor being that the guide member remain in the trench while the pipe is being removed. In the embodiment shown, member 32 is slightly spaced from the section boundary formed by the left hand outer wall of pipe 30.

Figure 11:
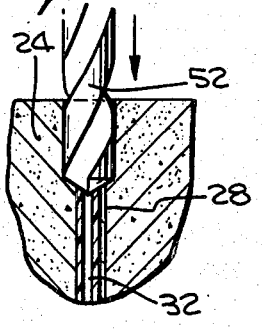
FIGS. 10–13 are fragmentary cross-sectional views showing successive steps in the formation of a liquid tight joint between adjacent sections of the foundation wall, all taken along line 10-13-10-13 of FIG. 8.
Figure 10:
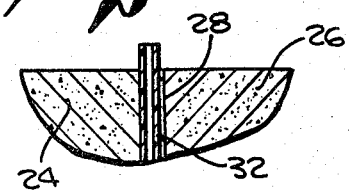

The cross-sectional appearance of interface 28 between sections 24 and 26, after removal of the isolation pipes and filling of section 26 with concrete, is shown in FIG. 10. Guide member 32 extends out of the trench parallel to and slightly offset to the left of interface 28. In the next step of the invention, illustrated in FIG. 11, a concrete drill 52 is used to drill a vertical bore along the entire depth of the wall, using member 32 as a guide. Drill bit 52 is larger in diameter than guide member 32, and overlaps interface 28 to extend the drill hole into section 26 as well as into section 24. Guide member 32 is preferrably about one inch to one and one half inches in diameter, while drill bit 52 is preferably about 4 inches in diameter.

Figure 12:
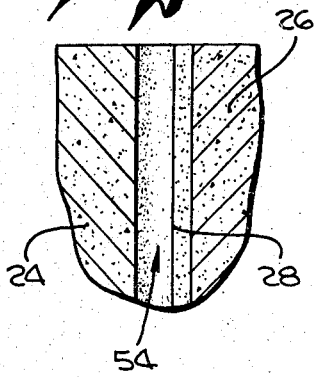

The drilling operation forms a bore 54, which extends across boundary 28 into both adjacent wall sections, as shown in FIG. 12. The interface between each successive pair of sections may thus be viewed as being characterized in a direction transverse to the flow of water along the interface by end portions 56 and 58 (see in FIG. 8) at which the two wall sections are mutually abutting, and by an intermediate portion comprising the drilled bore.

Figure 13:
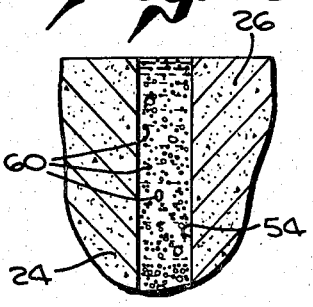

In the next step, illustrated in FIG. 13, bore 54 is filled with bentonite in the form of pellets 60 which have preferably been formed under high pressure to a diameter of approximately one centimeter. A preferred bentonite is sodium bentonite which is basically a hydratable montmorillonite clay having sodium as its predominant exchangeable ion. As noted above, sodium bentonite will swell in water and is therefore the type of bentonite which is most useful in the present invention. However, the bentonite utilized in the present invention may also contain other cations such as magnesium or iron.

The bentonite is preferrably prepared in the form of a contaminant resistant composition in accordance with the teachings of U.S. Pat. No. 3,949,560 by Arthur G. Clem, issued Apr. 13, 1976 and assigned to the assignee of the present invention, the contents of which are hereby incorporated herein by reference. This composition resists contamination from water which has acquired contaminants by passing over the concrete during transit along the interface to bore 54. The preferred composition as described in the referenced patent consists essentially of (A) bentonite; (B) a water-soluble dispersing agent selected from the group consisting of a water-soluble salt of phosphoric acid, a water -soluble sulfate of the formula ROSO3 X where R is hydrocarbon of from 8 to 32 carbon atoms and X is a member selected from the group consisting of an alkaline metal or ammonium, and a water-soluble salt of leonardite; and (C) a water-soluble polymer selected from the group consisting of polyacrylic acid, water-soluble salts of polyacrylic acid, hydrolyzed poly-acrylonitrile, polyvinyl acetate, polyvinyl alcohol, copolymers of the foregoing, and a copolymer of acrylic acid and maleic anhydride, the amount of water-soluble polymer in said soil sealant composition being from 0.1% to 3.0% by weight, and the amount of water-soluble dispersent in said sealant composition being from 0.1% to 3.0% by weight, the weight ratio of water-soluble dispersent to water-soluble polymer being from 6:1–36.

Figure 14:
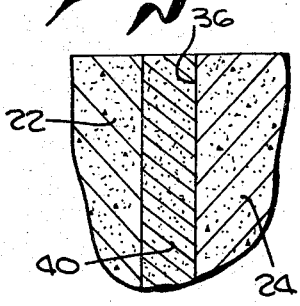
FIG. 14 is a fragmentary cross-sectional view taken along the line 14—14 of FIG. 8; showing a completed joint.

Once a bore has been filled with bentonite pellets, water seeping transversely through the wall along the joint between wall sections enters the bore and causes the pellets therein to gradually hydrate and swell. FIG. 14 shows a completed joint in which a suitable quantity of water has entered bore 36 to form a slurry with the bentonite pellets therein. The slurry establishes an intermediate liquid tight seal which prevents any liquid flow between the opposite end portions 56 and 58 (see in FIG. 8) of interface 38 between sections 22 and 24. The leakage problem is thereby solved in an efficient and inexpensive manner, without having to extend the excavation beyond the limits of the primary well or employing complicated recessing methods.

While a particular embodiment of the invention has been shown and described, numerous additional modifications and variations are possible in light of the above teachings. For example, while filling the bores with dry bentonite pellets and allowing the pellets to expand and form a slurry under the influence of water seeping in through the joints is the preferred method, a high viscosity slurry could be premixed and poured into the bore wet. This would be effective in that the high viscosity slurry would impede the passage of water by virtue of the swollen bentonite plugging the voids that might otherwise permit leakage through the joints.

Also, a number of different ways to provide a drilling guide may be envisioned, or the guide member may be dispensed with entirely and drilling performed only with the use of external guidance if the drilling equipment is suitable. In addition, while the preferred embodiment involves the construction of a liquid impermeable barrier in the ground, the invention could be applied to the construction of such barriers in bases other than soil. It is therefore intended that the scope of the invention be limited only in and by the terms of the appended claims.

We claim:

1. In the constructing of a water impermeable wall by a process comprising the steps of:

excavating a generally vertical trench;

substantially filling the trench with a water sealing slurry simultaneously with excavation thereof;

placing a pair of spaced generally vertical disposed isolating members in the trench with the members extending across the full width of the trench to isolate a first trench section therebetween, one of the members supporting a void forming member adjacent its side which faces the trench section, the void forming member being generally vertically disposed and substantially parallel to its supportive isolating member;

introducing a setable, water impermeable material into the first trench section and substantially simultaneously therewith displacing the slurry therefrom;

permitting the water impermeable material to harden sufficiently to assume the lateral contours of the isolating members;

detaching the void forming member from its supportive isolating member and removing only the isolating members from the trench;

placing a generally vertically disposed isolating member in the trench on the void forming members' side of and laterally spaced from the first section, thereby isolating a second trench section;

introducing a setable, water impermeable material into the second trench section, and substantially simultaneously therewith displacing slurry therefrom;

permitting the water impermeable material to harden to form a second wall section having a substantially continuous common lateral boundary with the first wall section;

removing the void forming member by withdrawing it intact leaving a void adjacent to the boundary of the first and second trench sections;

cleaning out the void;

boring the length of the void and adjacent water impermeable material with a drill of sufficient diameter to form a bore which overlaps the boundary along its full vertical extent and simultaneously extends into the wall material on either side of the boundary; and, introducing a water sealant material into the bore to establish a water-tight joint between the sections, the improvement comprising:

(a) providing the void forming member of a drillable material so as to be a drill guide member and releasably attaching it to the supportive isolating member in a manner such that the void forming drill guide member will automatically release from the supportive isolating member and remain in the water impermeable material when the supportive isolating member is removed; and (b) following removal of the supportive isolating member, drilling out the void forming drill guide member with a drill of sufficient diameter to form the overlapping bore along the full vertical extent of the boundary whereby the prior steps of manually detaching the void forming member, removing the void forming member by withdrawing it intact, and cleaning the void are eliminated from the procedure.

2. The improvement of claim 1 wherein:

the void forming drill guide member is attached to the supportive isolating member using a weak adhesive bond.

3. The improvement of claim 1 wherein:

the void forming drill guide member is attached to the supportive isolating member using a breakable coupling.

4. The improvement of claim 1 and additionally including the improvement for increasing the sealing of the boundary against water leakage comprising:

accomplishing the step of introducing a water sealant material into the bore by filling the bore with hydro-expandable bentonite in the form of pellets formed under high pressure to a diameter of approximately one centimeter.

* * * * *